United States Patent [19]

Gundlach et al.

[11] 4,111,389

[45] Sep. 5, 1978

[54] COLUMN DRAWING TABLE

[75] Inventors: Arnold Gundlach; Hans Eder, both of Wilhelmshavem, Germany

[73] Assignee: Franz Kuhlmann KG., Germany

[21] Appl. No.: 829,342

[22] Filed: Aug. 31, 1977

[30] Foreign Application Priority Data

Oct. 14, 1976 [DE] Fed. Rep. of Germany ..... 2646486

[51] Int. Cl.[2] ..... F16M 11/00

[52] U.S. Cl. ..... 248/162; 248/123

[58] Field of Search ..... 188/67, 129; 108/144, 108/147, 148; 248/123, 161, 162, 399, 400, 404, 410, 411, 414; 297/345, 347

[56] References Cited

U.S. PATENT DOCUMENTS

| | | | |
|---|---|---|---|
| 2,678,788 | 5/1954 | Paulson | 248/162 |
| 3,777,617 | 12/1973 | Okiyama | 297/347 |
| 3,908,944 | 9/1975 | Bjork | 248/162 |
| 3,989,211 | 11/1976 | Gundlach | 248/162 |

FOREIGN PATENT DOCUMENTS

| | | | |
|---|---|---|---|
| 2,211,946 | 2/1973 | Fed. Rep. of Germany | 248/162 |
| 2,513,128 | 9/1975 | Fed. Rep. of Germany | 248/162 |

*Primary Examiner*—Lawrence J. Staab

*Attorney, Agent, or Firm*—Weingarten, Maxham & Schurgin

[57] ABSTRACT

A column drawing table where the weight is equalized by a gas spring. This gas spring is supported in an elastic receptacle between the column and the pedestal foot, and the column is guided in a hollow pedestal so as to be movable along its length. It can be stopped at an arbitrary position by a fixing brake. A fall safety device, operative completely independently of the fixing brake, prevents the column from unintentionally sinking if the gas pressure in the gas spring should decline or if the fixing brake should be released.

11 Claims, 4 Drawing Figures

COLUMN DRAWING TABLE

FIELD OF THE INVENTION

This invention relates generally to column drawing tables and more particularly concerns an improved drawing table having a fall safety device which is activated if the internal equilibrium of the column mechanism is disturbed.

DISCUSSION OF THE PRIOR ART

With a known column drawing table (German Pat. No. 2,211,946) a fall protection device is used which prevents the column, under load from the drawing board and drawing machine, from undesirably or unintentionally sinking when the fixing brake is released or when the pressure in the gas spring has fallen so that the weight is no longer equalized. For this purpose a crosswise subdivided tubular piece is mounted in the foot of the column. The cylinder of the gas spring engages the upper portion of this piece and a pressure spring is tensioned in its lower portion. This pressure spring is supported against the foot. At the foot pedal lever of the fixing brake there is a projection which can be pivoted into the free space above the tubular piece only when the gas pressure has the predetermined value. As the gas pressure in the spring declines, that is, when the force of the pressure spring tensioned in the tubular piece becomes larger than the pushing force of the gas spring, the tubular piece is lifted up, so that the projection lies against the wall of the tube. In this way, the fixing brake is prevented from releasing.

Another fall protection device is shown in U.S. Pat. No. 3,989,211 in which a spring-loaded swivel frame is provided that is arranged crosswise in the column. A flap as well as two clamping elements and a counterweight are arranged between its spars. The flap can be pivoted by the air pressure which results when the column suddenly sinks whereby the clamping elements engage the piston of the gas spring. In practice, however, it has turned out that a certain threshold sinking speed is required to activate the fall protection device where this sinking speed generates a corespondingly strong air current. Consequently, when the unintentional sinking is rather slow this protective device is not fully effective.

A column drawing table with a fixing brake, a gas spring for weight equalization, and a fall protection device has already also been proposed in German patent application P 25 13 128.6. With this drawing table, the fixing brake engages one side of the column and is linked through a parallelogram on the pedestal. The fixing brake is hung on a tension spring on the pedestal where this tension spring acts in the release position. When the gas pressure falls the coupling between the tension spring, acting in the release direction and the brake, is eliminated so that the fixing brake can no longer be released. The fall protection device responds at the slightest deviation and release is not so simply possible.

The known fall protection devices have one thing in common, namely that their action is in every case combined with the fixing brake. They either block its activation so that the brake cannot be released, or they decouple it so that the connection between the foot pedal and the brake is interrupted. With these known designs, however, the so called disconnecting force has a noticeable disadvantageous effect when the fall protection device is triggered. This disconnecting force, for example, can occur by constraints in the mechanical parts in the gas spring itself as friction between the pressure piston and the cylinder. After a longer idling pause, it always occurs when the piston rod of the gas spring is moved. Its magnitude was measured at 10–17 kg, while the normal activating force is only about 1–2 kg. If the fall protection device is then, for example, set at a value of about 6 kg and if the disconnecting force is set at the following usual value of 12 kg, then the known fall protection devices would only come into play when the pressure is reduced over 12 kg. Up to this value a fall protection device would merely be an illusion. A drawing table which falls down with a weight of 6 kg might just be barely tolerable; at 12 kg considerable injuries will certainly result.

The known standard fall protection devices furthermore respond when the drawing board is additionally loaded beyond a prescribed extent, such as by the draftsman leaning on it, even if the internal pressure of the gas spring remains normal. This extra load can, for example, be greater than 6 kg.

After such a supporting action it is no longer possible to release the fixing brake in order to move the drawing table, but the fall protection device must first be loosened and this is often not so simple.

SUMMARY OF THE INVENTION

It is an object of this invention to create a column drawing table which avoids the difficulties mentioned above and whose fall protection device is independent of the disconnecting force and independent of the load on the drawing table.

According to the invention the fall protection device is completely independent of the fixing brake and includes an adjustable tension spring. This tension spring together with a gas spring engages a pivoting lever which is coupled with a clamping element.

The fall protection device according to the invention is completely independent of the disconnecting force in the entire system, that is for example, from the constraint between the piston and the cylinder in the gas spring and from the load on the table. It cannot be initiated by applying a greater load to the drawing board. The fall protection device according to the invention represents an optimum of safety, since it is impossible for the table to sink unintentionally when the fixing brake is released. If the internal equilibrium is disturbed the pivoting lever, which acts as a scale beam, moves outwards and the fall protection device becomes effective. If the fixing brake is released in such a case, the column with its drawing board cannot sink, and specifically without regard to a possibly existing disconnecting force. When equilibrium exists the normal action of the drawing table is in no way inhibited. The fall protection device can be monitored at any time without special expert knowledge. This is true because, when the column is somewhat extended, the position of the pivoting lever relative to the markings can be easily checked through a viewing window in the column or in the pedestal, or both.

Since the gas-fill stud is easily accessible from the outside, the fall protection device can easily be again released by refilling the gas cylinder. The individual components are simple and require no special maintenance so that here too no difficulties can occur even over the longer term. Another advantage consists of the fact that the various parts of the fall protection device can be used without change with different types of drawing tables. By externally adjusting the tension spring which acts opposite to the gas spring, functional capability can be maintained even when drawing tables of different size and weight are used. The reason for this is that only the tension spring must be adjusted.

BRIEF DESCRIPTION OF THE DRAWING

The objects, advantages and features of this invention will be easily understood from the following detailed description when read in conjunction with the accompanying drawing in which.

DESCRIPTION OF THE PREFERRED EMBODIMENT

Figure 1:
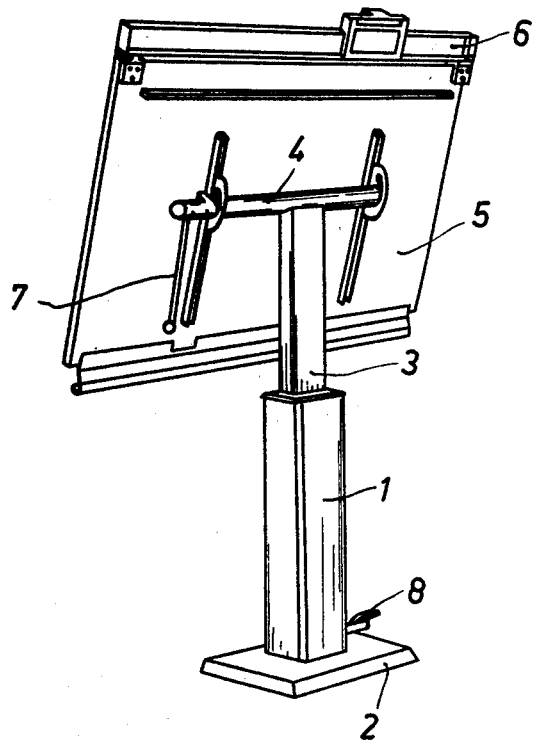
FIG. 1 is a perspective view of a column drawing table.

With reference now to the drawing and more particularly to FIG. 1 thereof, there is shown a pedestal 1 with a stable pedestal foot 2, a column 3 which can be vertically displaced in the pedestal, an inclination adjustment 4 and a drawing board 5 with the carriage drawing machine 6. A clamping brake activated by a hand lever 7 serves to fix a particular position of inclination of the drawing table. The fixing brake within the pedestal with its pedal 8, as can be seen in FIG. 2, serves to fix column 3 at a desired height level.

Figure 2:
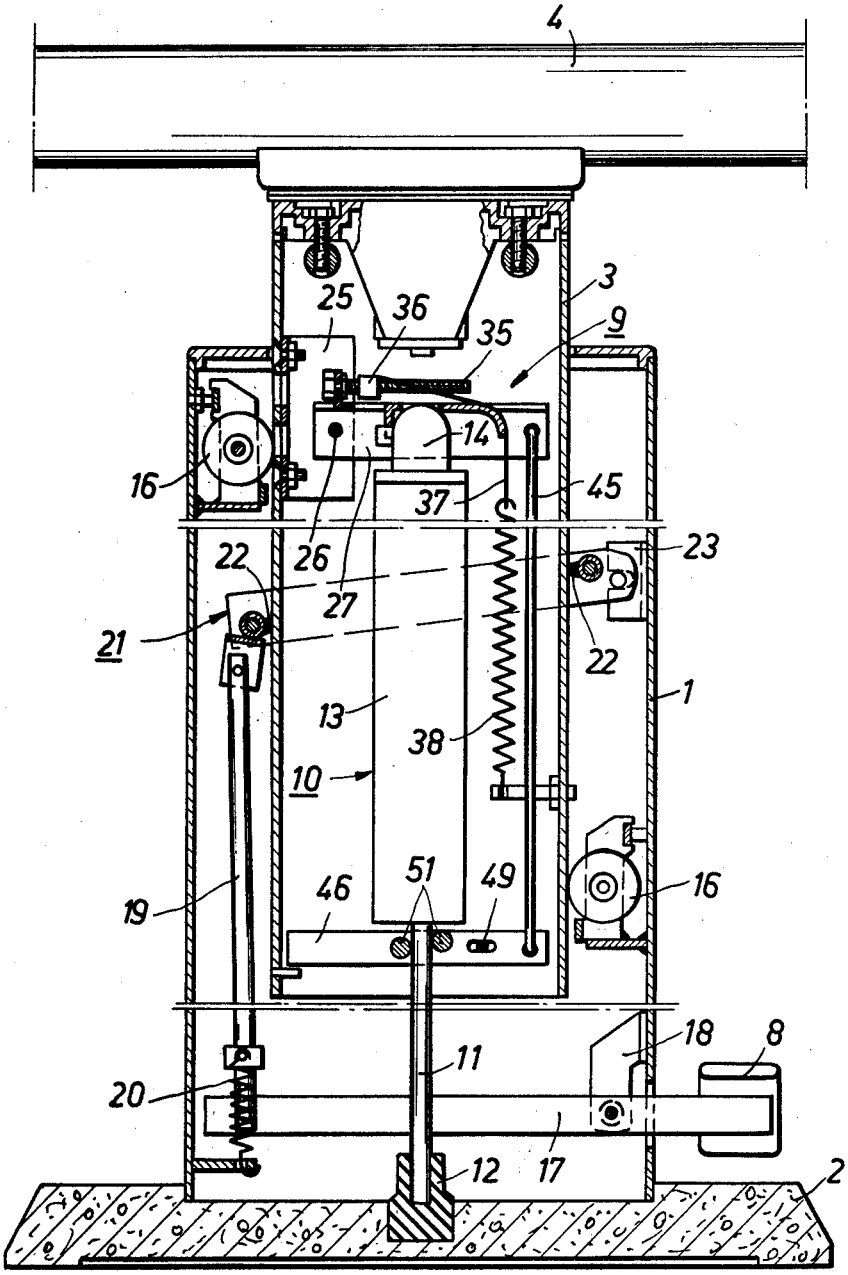
FIG. 2 is a vertical section through the pedestal with the column partially inserted.

As is shown in detail in FIG. 2, gas spring 10 is tensioned in column 3 between pedestal foot 2 and a mount (generally designated by 9). The piston 11 of this gas spring engages an elastic rubber recess 12 in the pedestal foot. This recess serves to dampen impacts and noise. The cylinder 13 of the gas spring has an upper axial stop 14, at which is provided a lateral valve stud 15 for introducing the pressure agent (see FIG. 3).

To support and guide the gas spring cylinder 13 laterally, profiled projections (not shown) can be provided at the interior surface of the lengthwise column walls. These projections surround the gas spring cylinder and thus support it against tilting.

The height of column 3 with respect to the pedestal can be adjusted. To guide column 3 and pedestal 1, rollers 16 are provided which act together with guide rails in the column. These rollers can always be mounted in pairs of movable mountings which are held in the pedestal.

In order to fix column 3 at a definite height in the pedestal, a fixing brake is used which can be activated through foot pedal 8. A double-arm lever 17 supports pedal 8 and is pivotably mounted to pedestal brackets 18. A rod 19 is linked at the free end of this lever and by means of a spring 20, which is connected to the pedestal foot, this rod is pulled downwards. The upper end of the rod engages a rectangular frame 21 which surrounds the column. The lengthwise spars of rectangular frame 21 are connected by crosswise rods. On these rods are seated clamping pieces 22 which act on the outer walls of column 3. The crosswise rod situated opposite to the engagement point of the rod is pivotably mounted in brackets 23 on the pedestal. This fixing brake is kept in the braking position shown in FIG. 2 by means of spring 20. In this position the clamping pieces lie solidly against the column walls through both the column's own weight and the spring force. In this position, the column is secured against every vertical displacement. By depressing brake pedal 8, frame 21 is pivoted in brackets 23 so that clamping pieces 22 come loose from the wall of the column and the column, together with the drawing board, can be moved up and down with respect to the pedestal and pedestal foot.

A special fall protection device is provided as protection against the sudden undesired sinking of column 3 into pedestal 1 such as when the fixing brake is released or when the pressure in the gas spring is reduced. This fall protection device will be explained in detail by means of FIGS. 3 and 4. The device comprises two components, namely a scale which forms the upper mount 9 of gas spring 10 in column 3, and a brake which acts on piston 11 of the gas spring.

A frame 25 is fastened on the interior wall of column 3 at the height of the projection 14 of the gas spring. On this frame 25 a pivoting lever 27 which forms a scale beam, is coupled with trunnions 26. This profiled pivoting lever has at least one flat, elongated arm 28, which extends transverse to the long axis of the column and has a flat surface parallel to that axis, and a beam 29 which is bent at a right angle to the arm 28. The beam 29 has a hinge pan 30 approximately at the center of pivoting lever 27. The front portion of the projection 14, which is of convex design flexibly engages the hinge pan 30. Furthermore, from the beam 29, approximately at the region above the trunnion 26, a flange 31 is bent upward and, next to the hinge pan, a guide rail 32 is bent downward. A bracket 33 is bent vertically out of the beam 29 and is formed with a slit which surrounds the filling stud 15 of the gas spring 10. Consequently, it forces the filling stud 15 into its position aligned with opening 41 through which the stud is accessible from the outside. An adjustment device such as a screw 35 runs approximately parallel to and above pivoting lever 27. This adjustment screw 35 is arranged rotatably and is axially secured in a bore formed in flange 31. A moving nut or positioning member 36 is engaged on this adjustment screw. A flexible band or pulling element 37, for example a steel band or cord, is affixed to this nut. The band runs over the guide rail 32 which is bent downward and a tension coil spring 38 is suspended at its end. The free end of this spring is hung in a bolt 39 (see FIG. 4) which is fixed to the wall of the column.

Also in the column wall, another opening 40 is provided through which the positioning screw 35 can be adjusted from the outside. By turning the adjustment screw 35, spring 38 can be tensioned and untensioned. This spring serves as a counterweight to the gas spring and equilibrium can be adjusted through this positioning screw.

Figure 3:
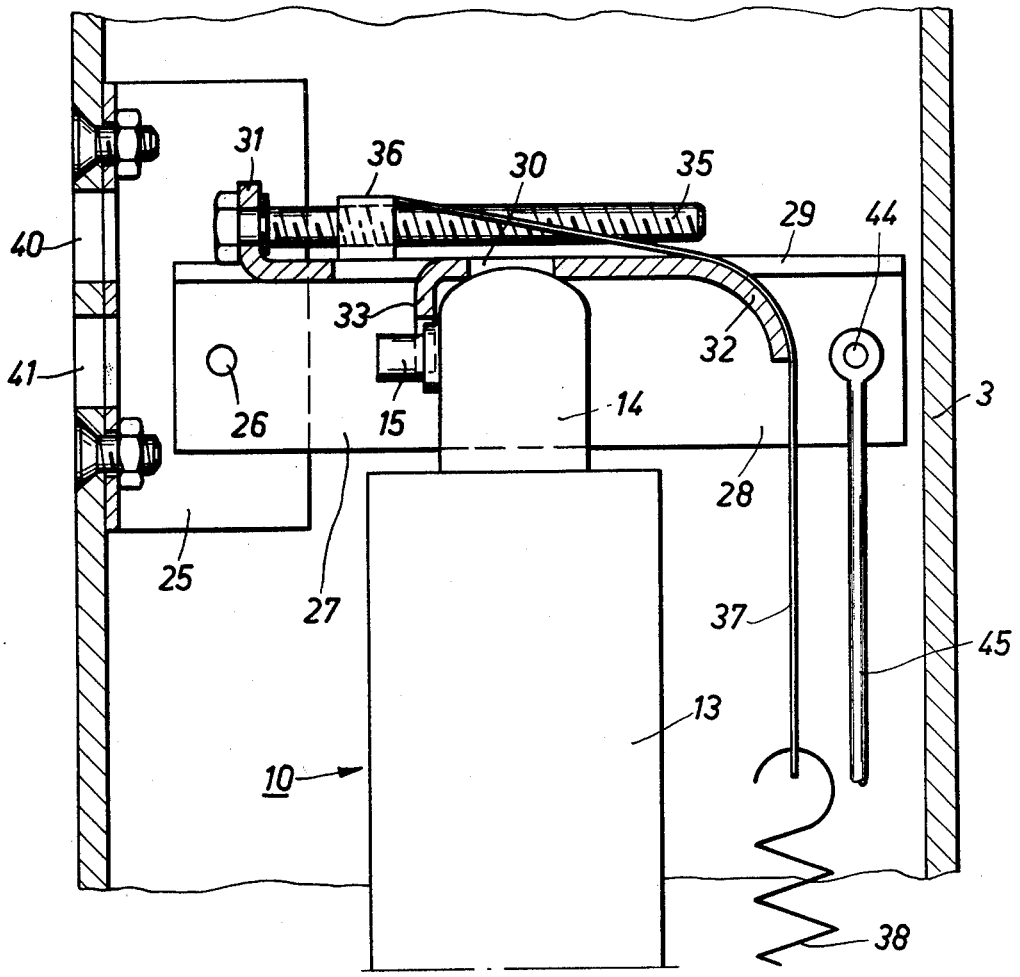
FIG. 3 shows an enlarged vertical section in the upper area of FIG. 2.
Figure 4:
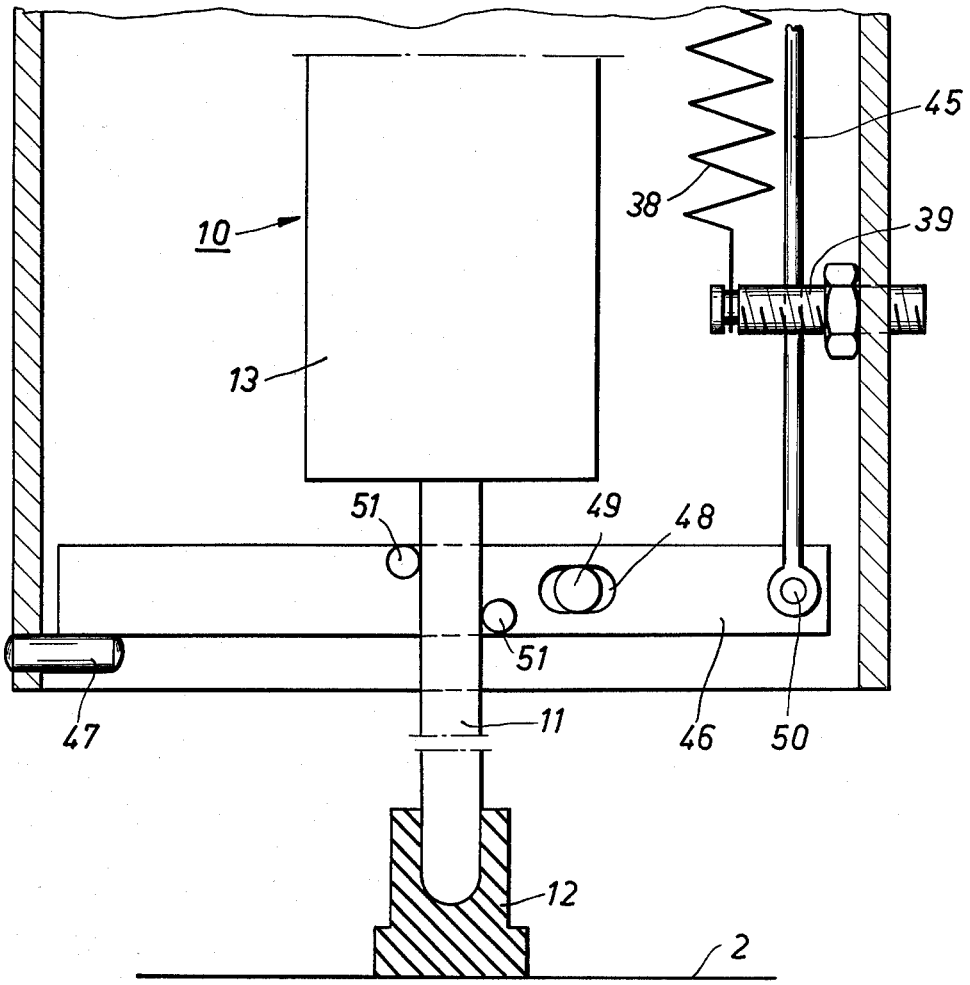
FIG. 4 shows an enlarged vertical section in the lower area of FIG. 2.

As can be seen from FIGS. 3 and 4, at the free end of the pivoting lever 27 a pull rod 45 is coupled to a trunnion 44. This pull rod forms the connection of the scale with the braking members of the fall protection device. Below the gas spring cylinder 13, in the area of piston 11, a blocking arm 46 or a blocking frame is arranged perpendicular to the long axis of the column and is mounted on a fixed bolt 49 by means of a lengthwise hole 48. On one of its free ends, blocking arm 46 is coupled through a trunnion 50 to pull rod 45. Its other free end is supported on a bolt 47 which is affixed to the column. At both sides of the piston rod 11 of gas spring 10 clamping members 51 are provided at the blocking arm 46. When the blocking arm pivots, the clamping elements 51 wedge against the piston rod and thus intercept the weight of column 3 and all parts connected therewith. This pivoting is effected by the pull rod 45 when either the equilibrium at the scale or at the pivoting lever 27, or both, is disturbed.

In order to set up the fall protection device, moving nut 36 is displaced horizontally by turning the positioning or adjustment screw 35. In this way the pull band 37 can be moved downwardly and spring 38 can be inserted. By screwing the moving nut backwards, an equilibrium can subsequently be adjusted between the interior pressure in the gas spring which corresponds to the weight of the drawing board with its accessories, and the pulling force of spring 38. At the same time, the position of lever 27 can be observed through a viewing window (not shown) in the column or in the pedestal. Care can be taken that pivoting lever 27 lies horizontal as a scale beam. This viewing window is arranged at the column so that, when the pivoting lever is in the correct position, the trunnion 44 is fully visible from the outside. Appropriate markings can here be provided so that a precisely horizontal position of the pivoting lever 27 can be adjusted.

If the pressure in the gas spring now falls, the equilibrium is disturbed and the tension spring 38 pulls the lever 27 about its fulcrum 26 so that its free end pivots downwardly and consequently takes along the rod 45 in a downward direction. This rod pivots the blocking arm 46 which shifts laterally in the long hole 48. It thus brings the clamping elements 51 to adhere firmly against the piston rod 11.

If the fall protection device has once been activated, it can again be released by restoring the equilibrium between the gas spring and the tension spring. In the case of a normal fall, it will suffice to bring the gas spring again to normal pressure. It is here suitable also to check the position of the pivoting lever 27 by means of a simple check through the viewing window.

Since the fixing brake and the fall protection device are completely separated from one another and are also activated completely independently, no constraint in the system can have a disadvantageous effect on the fall protection device.

In view of the above description it is likely that modifications and improvements will occur to those skilled in the art which are within the scope of this invention.

What is claimed is:

1. A column drawing table comprising:

a pedestal foot;

a pedestal mounted on said pedestal foot;

a column mounted in said pedestal for longitudinal displacement therein;

a gas spring, one end of which is elastically supported in said pedestal foot, the other end supporting said column, said gas spring acting to equalize the weight of said drawing table, said gas spring generally comprising a piston and a cylinder, one of which is stationary with respect to said pedestal foot;

a fixing brake coupled between said pedestal and said column to secure said column in arbitrary longitudinal positions; and a fall safety device to prevent unintentional downward motion of said column when the equilibrium of said column is disturbed, said fall safety device being completely independent of said fixing brake and comprising:

a lever pivotably connected at one end to said column;

a tension spring;

adjustment means coupling the other end of said lever to one end of said tension spring, the other end of said spring being connected to said column to thereby bias said other end of said lever downwardly, said lever being engaged by said gas spring intermediate its ends; and clamping means coupled between said lever and said one end of said gas spring to prevent unintentional downward movement of said column with respect to said pedestal.

2. The column drawing table recited in claim 1 wherein said clamping means comprises:

a rod a blocking arm, said rod being pivotably coupled between said other end of said lever and one end of said blocking arm;

means for pivotably coupling said blocking arm intermediate its ends to said column;

means on said column for supporting the other end of said blocking arm; and clamping members on said blocking arm for selectively engaging said stationary portion of said gas spring.

3. The column drawing table recited in claim 1 wherein said adjustment means comprises:

an adjustment device mounted to said lever;

a positioning member mounted for selective linear motion on said adjustment device; and a flexible pulling element coupling said one end of said tension spring to said positioning member.

4. The column drawing table recited in claim 3 wherein said adjustment device is formed with external threads, is arranged parallel to said lever and is axially fixed on said lever, said positioning member is an internally threaded nut threaded on said adjustment device.

5. The column drawing table recited in claim 1 wherein the wall of said column is formed with a viewing window through which markings placed on said lever can be seen from the outside.

6. The column drawing table recited in claim 3 wherein said lever is formed with a beam which runs perpendicular to the long axis of said column, said beam being formed with a mount for said adjustment device and a curved guide for said pulling element.

7. The column drawing table recited in claim 6 wherein:

said gas spring is formed with a filling stud;

a bracket is formed out of said beam, said beam being formed with a slit arranged to overlap said filling stud.

8. The column drawing table recited in claim 6 wherein said column wall is formed with openings, one of said openings being aligned with said adjustment device and the other being aligned with said filling stud, both said adjustment device and said filling stud being accessible from the outside through said openings.

9. The column drawing table recited in claim 1 wherein said lever is connected to said column by means of a frame fastened on the interior wall of said column.

10. The column drawing table recited in claim 3 wherein said flexible pulling element is a steel band or a steel cord.

11. The column drawing table recited in claim 6 wherein said beam is formed with a flexible grip for engaging said other end of said gas spring.

* * * * *